US008366470B2

(12) United States Patent
Sakakura

(10) Patent No.: US 8,366,470 B2
(45) Date of Patent: Feb. 5, 2013

(54) CONNECTOR

(75) Inventor: Kouji Sakakura, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 336 days.

(21) Appl. No.: 12/752,227

(22) Filed: Apr. 1, 2010

(65) Prior Publication Data

US 2010/0261363 A1 Oct. 14, 2010

(30) Foreign Application Priority Data

Apr. 9, 2009 (JP) ..... 2009-094930

(51) Int. Cl.
*H01R 13/52* (2006.01)

(52) U.S. Cl. ..... 439/272

(58) Field of Classification Search ..... 439/271, 439/272, 273, 274, 283, 587
See application file for complete search history.

(56) References Cited

U.S. PATENT DOCUMENTS

| | | | | |
|---|---|---|---|---|
| 5,158,391 | A * | 10/1992 | Fujitani et al. | 439/271 |
| 6,953,357 | B2 * | 10/2005 | Fukushima et al. | 439/271 |
| 7,011,539 | B1 * | 3/2006 | Nagy et al. | 439/271 |
| 7,329,145 | B2 * | 2/2008 | Yagome et al. | 439/271 |
| 7,572,150 | B2 | 8/2009 | Matsuoka | |

* cited by examiner

*Primary Examiner* — Felix O Figueroa
(74) *Attorney, Agent, or Firm* — Gerald E. Hespos; Michael J. Porco

(57) ABSTRACT

A connector has a housing with a fit-on tube that can fit in a hood of a mating connector. Terminal fittings are fixed to ends of wires and are held by the housing. A sealing ring is mounted on an annular holding groove on a peripheral surface of the fit-on tube and is disposed between the peripheral surface of the fit-on tube and an inner surface of the hood to seal a gap therebetween. Engaging grooves are formed in the peripheral surface of the fit-on tube. The engaging grooves intersect the annular holding groove and are deeper than a bottom surface of the annular holding groove. Rotation-stopping projections project from the sealing ring to extend along a direction in which the engaging grooves extend and each has an engaging claw that can fit on a bottom of one of the engaging grooves.

3 Claims, 8 Drawing Sheets

CONNECTOR

BACKGROUND OF THE INVENTION

1. Field of the Invention

The invention relates to a connector having a sealing ring.

2. Description of the Related Art

Patent document 1 discloses a connector for supplying electric power to devices, such as a motor, of an electric car. The motor is accommodated inside a case made of a metal. The connector has a device-side connector with a housing mounted in a mounting hole that horizontally penetrates the case and a harness-side connector with a housing mounted on terminals of electric wires. The housing of the harness-side connector has a tubular fit-on portion that is fit in a tubular hood of the device-side housing.

A sealing ring is mounted in an annular holding groove formed on the peripheral surface of the fit-on tubular portion of the harness-side connector. The sealing ring is comparatively flexible and annular, and therefore is apt to deviate and rotate. Accordingly, a rotation-stopping groove is formed in the peripheral surface of the fit-on tubular portion of the harness-side connector and extends continuously from the annular holding groove in a direction orthogonal to the annular holding groove. A rotation-stopping projection is formed on the sealing ring and is fit into the rotation-stopping groove to prevent the sealing ring from dislocating and rotating.

The bottom surfaces of the annular holding groove and the rotation-stopping groove of the housing of the above-described conventional connector have an equal depth, have no irregularities formed thereon, and are continuous with each other. Similarly, there are no radial steps or irregularities where the rotation-stopping projection projects continuously from the sealing ring.

A comparatively large force can be applied to the sealing ring as a result of inadvertent touching by an operator when handling a wire harness where the above-described connector has been mounted. This force can be applied in a direction that causes the rotation-stopping projection to float from the rotation-stopping groove, and hence the sealing ring may rotate along the annular holding groove.

The invention has been made in view of the above-described situation. Therefore it is an object of the invention to provide a connector in which a sealing ring will not rotate inadvertently on a fit-on tubular portion.

SUMMARY OF THE INVENTION

The invention relates to a connector with a housing that has a fit-on tubular portion that can be fit in a tubular hood of a mating connector. Terminal fittings are fixed to ends of electric wires and are held by the housing. The fit-on tubular portion has an annular holding groove and a sealing ring is mounted on the annular holding groove. The sealing ring is dimensioned to seal a gap between the peripheral surface of the fit-on tubular portion and the inner peripheral surface of the tubular hood. Engaging grooves are formed in the peripheral surface of the fit-on tubular portion and extend continuously from the annular holding groove in a direction to intersect the annular holding groove. The engaging grooves subside deeper than a bottom surface of the annular holding groove. Rotation-stopping projections project from the sealing ring and extend along a direction in which the engaging grooves extend. Each rotation-stopping projection has a distal end with an engaging claw configured for fitting on a bottom of one of the engaging grooves.

The above-described annular holding groove and the engaging groove are formed in the peripheral surface of the fit-on tubular portion. However, the engaging groove is deeper than the annular holding groove. The rotation-stopping projection projects continuously from the sealing ring and the engaging claw is formed continuously with the distal end of the rotation-stopping projection. The sealing ring is mounted to the annular holding groove so that the engaging claw engages the relatively deep engaging groove. A force may be applied to the sealing ring in a direction along the annular holding groove. However, the engaging claw does not disengage easily from the engaging groove and securely holds the sealing ring in the annular holding groove.

The fit-on tubular portion preferably is oblong in a section crossing an axis thereof. Two rotation-stopping projections preferably are formed on longitudinal straight portions of the oblong section of the fit-on tubular portion.

The rotation-stopping projection conceivably could be formed at a circular-arc portion of the oblong section of the fit-on tubular portion. However, in this situation, a force inadvertently applied to the sealing ring would be liable to cause the circular-arc portion of the sealing ring to float from the annular holding groove and similarly would be liable to cause the rotation-stopping projection to float from the engaging groove. However, the rotation-stopping projection preferably is formed on the longitudinal straight portions of the oblong section of the fit-on tubular portion. Accordingly, the sealing ring is less likely to float from the annular holding groove when a force is applied to the sealing ring. Therefore, the rotation-stopping projection sufficiently displays its rotation-stopping function.

The rotation-stopping projections are formed as a pair on each of the longitudinal straight portions of the oblong section of the fit-on tubular portion. Therefore, a force applied to the sealing ring is received almost equally by the rotation-stopping projections to securely prevent the sealing ring from dislocating from the annular holding groove.

As described herein the invention securely stops the sealing ring from being rotated.

DETAILED DESCRIPTION OF THE PREFERRED EMBODIMENTS

Figure 2:
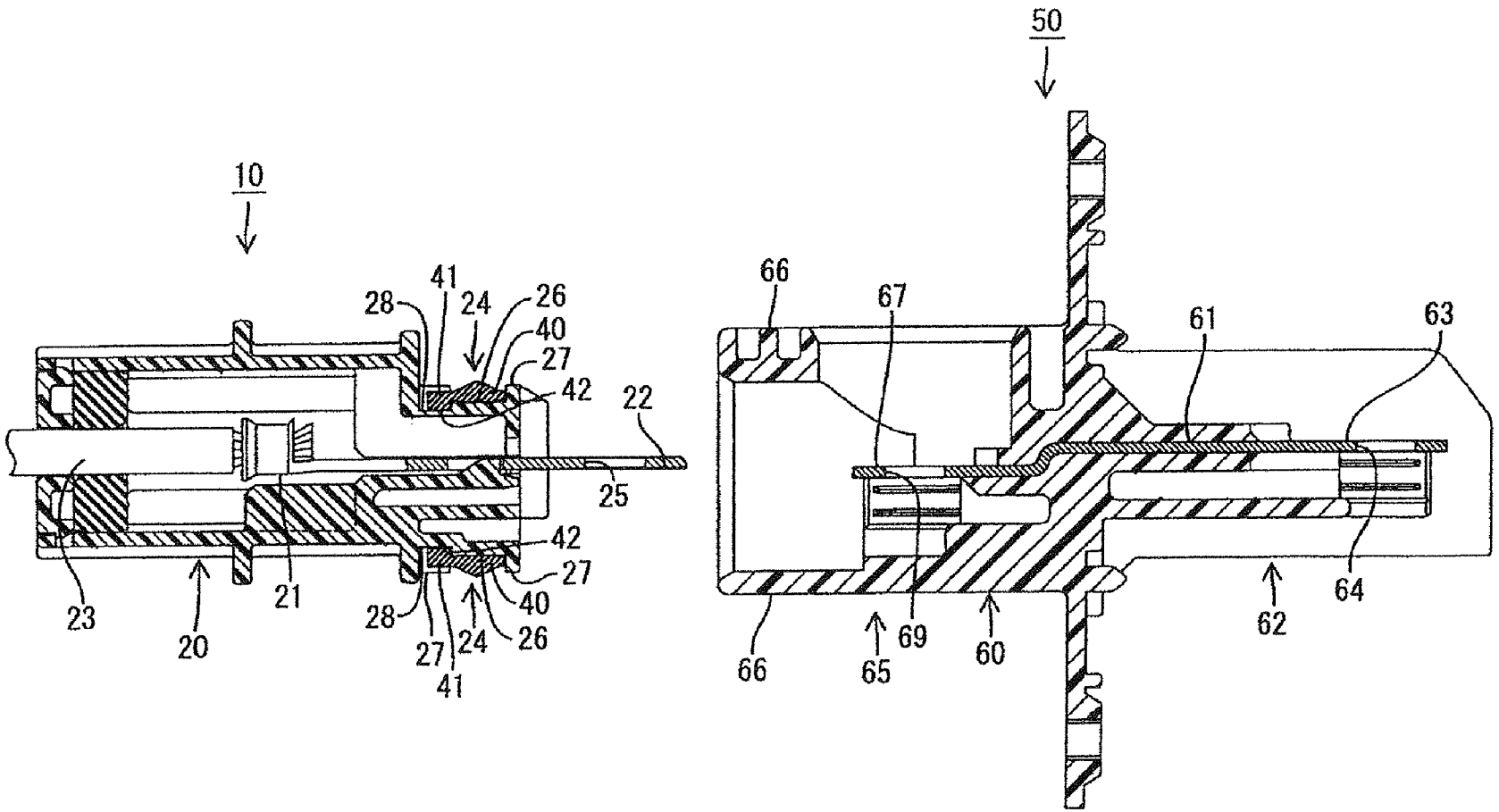
FIG. 2 is a sectional view before an electric wire-side connector housing and a device-side connector housing fit on each other.

A connector in accordance with the invention is identified by the numeral 10 in FIG. 2. The connector 10 has an electric wire-side housing 20. A device-side connector 50 is to be connected to the connector 10 and supplies electric power to unshown devices, such as a motor or inverter mounted on a hybrid car or the like. The device-side connector 50 has a device-side housing 60 that can be fit on the electric wire-side housing 20 and separated therefrom.

Fit-on sides of both housings 20, 60 are set as the front side of each member. The devices are accommodated inside a case C made of a metal and having a shielding function. A mounting hole H horizontally penetrates through the case C.

FIG. 2 shows one of three bus bars 61 that are integrated with the device-side housing 60 by insert molding. The bus bars 61 connect to front ends 22 of electric wire-side terminals 21 to each other respectively. The device-side housing 60 has a projection 62 and each bus bar 61 has a device-side connection portion 63 at the device-side projection 62 of the device-side housing 60. A bolt hole 64 is formed at each of the device-side connection portions 63 to connect the device-side connection portions 63 to the unshown device-side terminals by tightening bolts.

The device-side housing 60 has an electric wire-side projection 65 with a long tubular hood 66. An electric wire-side connection portion 67 is formed at a side of each bus bar 61 opposite the device-side connection portion 63 of the bus bar 61 and projects into the long tubular hood 66.

Figure 1:
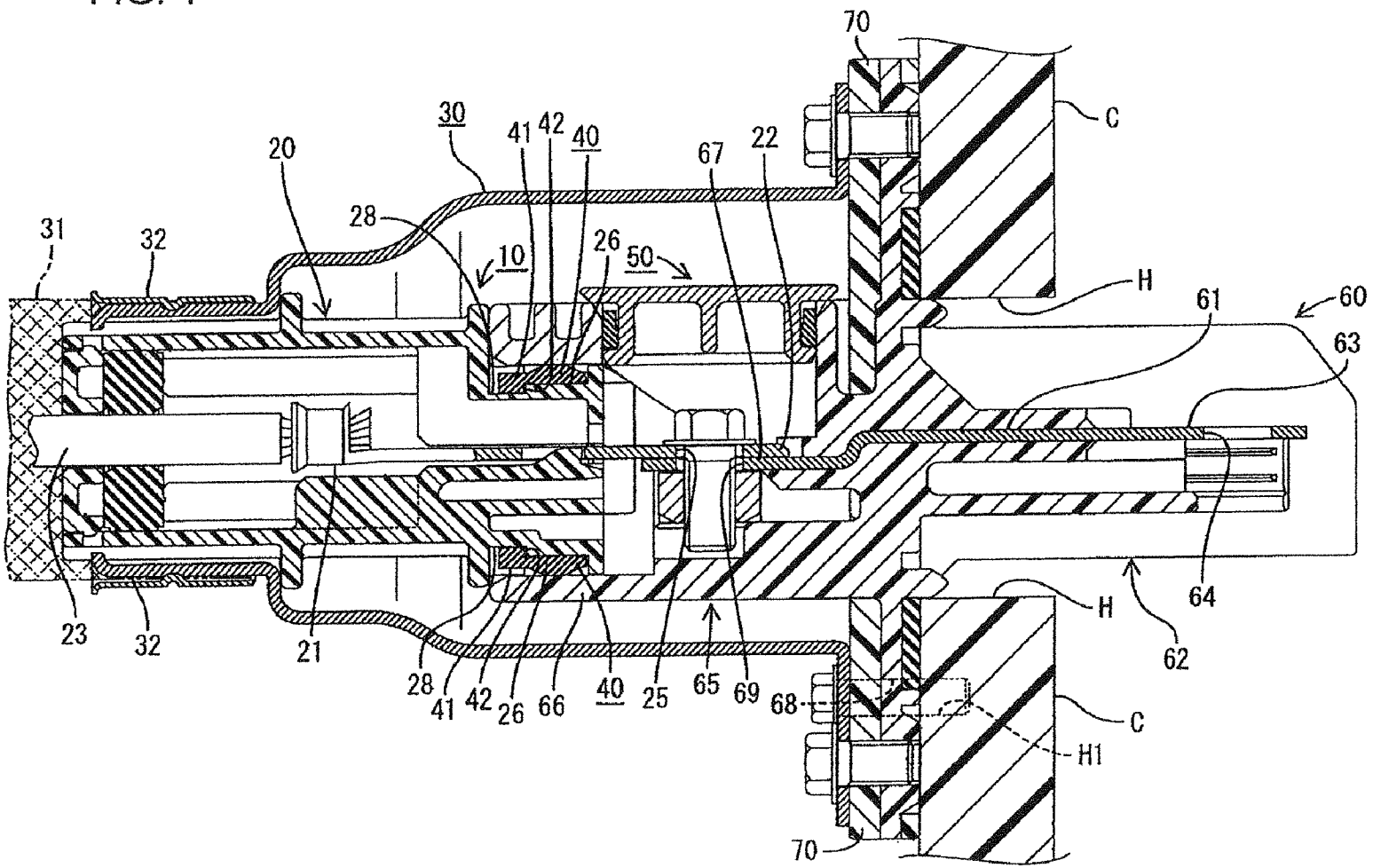
FIG. 1 is a sectional view of a fit-on state of a connector of one embodiment of the present invention.

A connector-mounting plate 70 is formed by aluminum die casting and is fixed to a periphery of the device-side housing 60 with a screw, as shown in FIG. 1. Insertion holes 68 are formed at four corners of the device-side housing 60. The device-side housing 60 is fixed to the case C by tightening screws into the insertion holes 68 and into screw holes H1 of the case C.

The electric wire-side housing 20 is made of synthetic resin and accommodates the three electric wire-side terminals 21 fixed to ends of electric wires 23, as shown in FIG. 2. A fit-on tubular portion 24 is formed at a front end of the wire-side housing 20 and has an oval cross section orthogonal to an axial direction of the electric wire-side housing 20. The front end 22 of each electric wire-side terminal 21 projects forward beyond the fit-on tubular portion 24. The fit-on tubular portion 24 of the electric wire-side housing 20 is fit in the long cylindrical hood 66 of the device-side housing 60 so that the front end 22 of the electric wire-side terminal 21 overlaps the electric wire-side connection portion 67 of the bus bar 61. A bolt hole 25 is formed at the front end 22 of the electric wire-side terminal 21 and overlaps an insertion hole 69 of the bus bar 61.

An electric wire-side shielding shell 30 is mounted on the electric wire-side housing 20 and includes a press steel plate that covers the electric wire-side housing 20, as shown in FIG. 1. An end of a shielding 31 is made of braided wires and collectively surrounds the electric wires 23. A caulking ring 32 fixes the shielding 31 to the electric wire-side shielding shell 30. The electric wire-side shielding shell 30 is fixed to the case C with screws through the connector-mounting plate 70. The electric wire-side shielding shell 30 and the connector-mounting plate 70 cover and shield the electric wire-side housing 20 and the device-side housing 60 fit thereon.

As shown in FIGS. 1 and 2, an annular holding groove 26 is formed along a peripheral surface of the fit-on tubular portion 24 of the electric wire-side connector housing 20. The width and depth of the annular holding groove 26 are set to 7 mm and 1 mm respectively.

Figure 8:
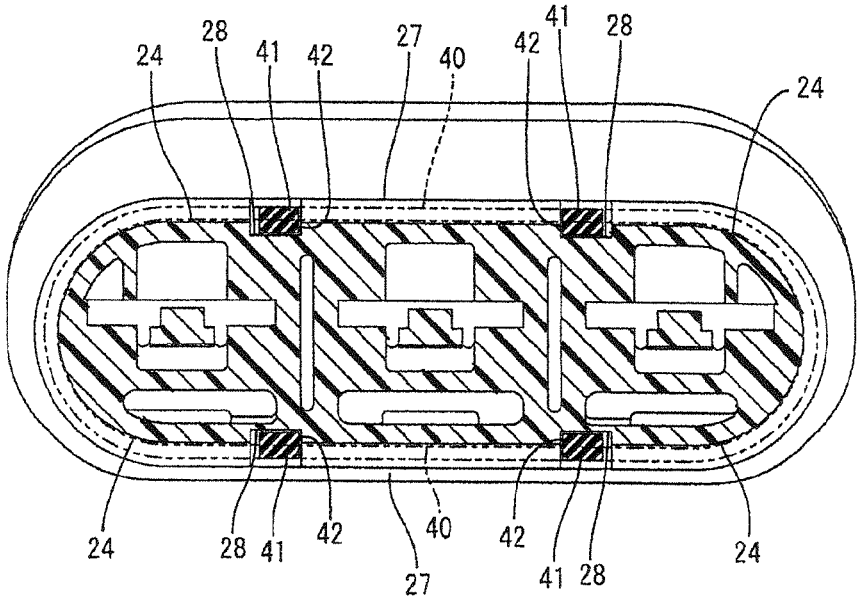
FIG. 8 is a sectional view of a portion where a rotation-stopping projection and an engaging claw are present in a state where the sealing ring is mounted on the connector housing.

Two engaging grooves 28 are formed continuously with the annular holding groove 26 on each of vertically opposed flat surfaces (see FIG. 8) 27 of the fit-on tubular portion 24. The engaging grooves 28 are formed by extending them rearward along a direction in which the engaging grooves 28 intersect with the annular holding groove 26, for example, along a direction in which the engaging grooves 28 are orthogonal to the annular holding groove 26. Each of the vertically opposed the engaging grooves 28 is formed deeper (for example, 2.5 mm) than the annular holding groove 26 by one stage. The width and length of each engaging groove 28 are set to 4 mm.

Figure 3:
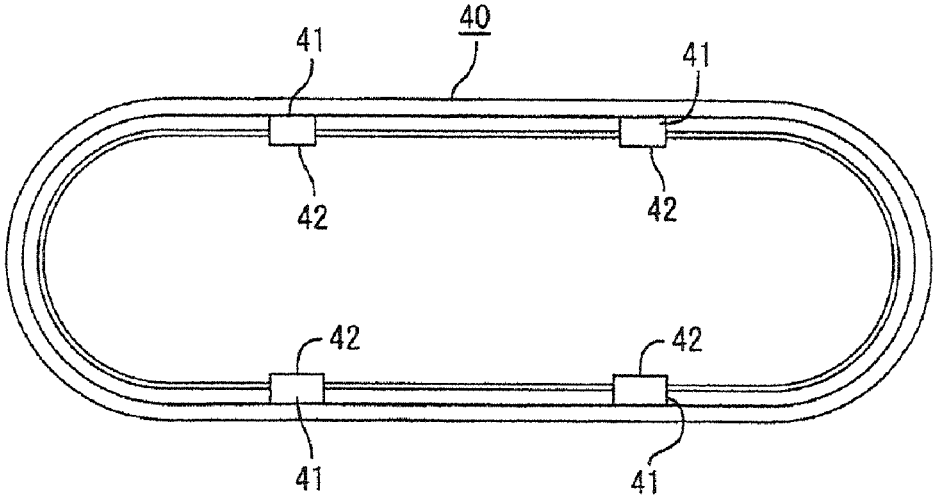
FIG. 3 is a rear view of a sealing ring.
Figure 4:
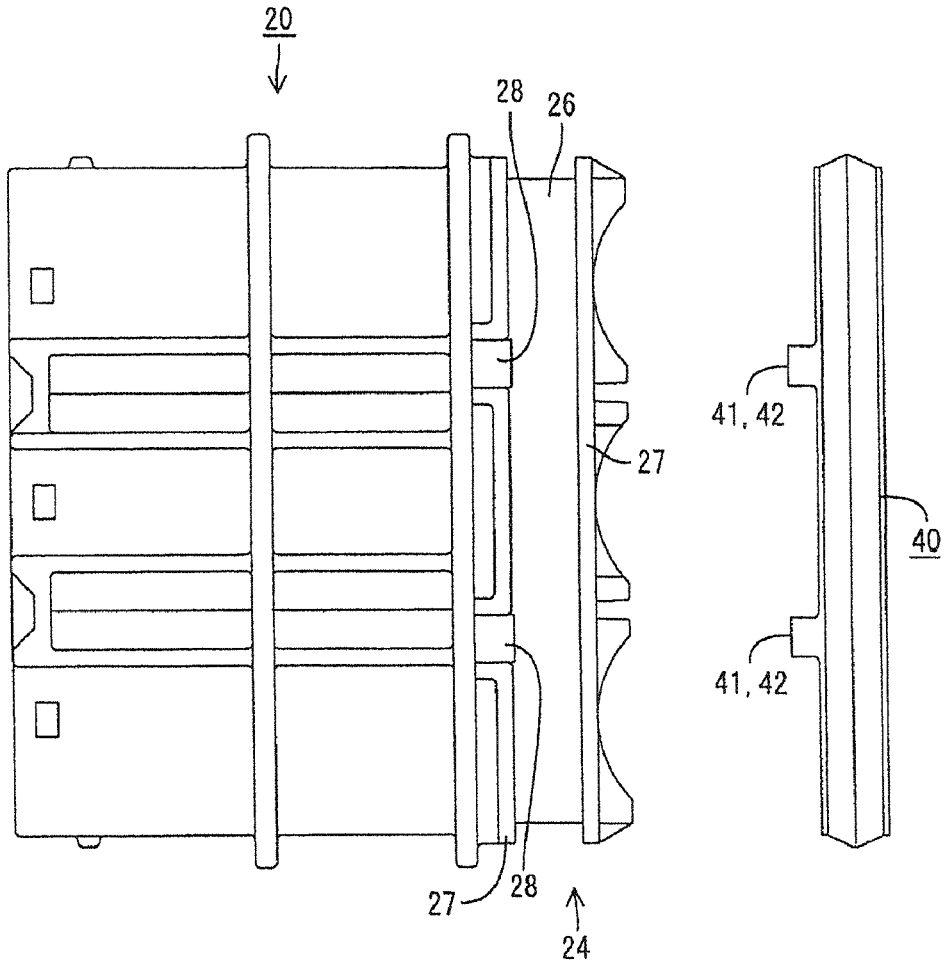
FIG. 4 is a plan view of a connector housing and the sealing ring.
Figure 5:
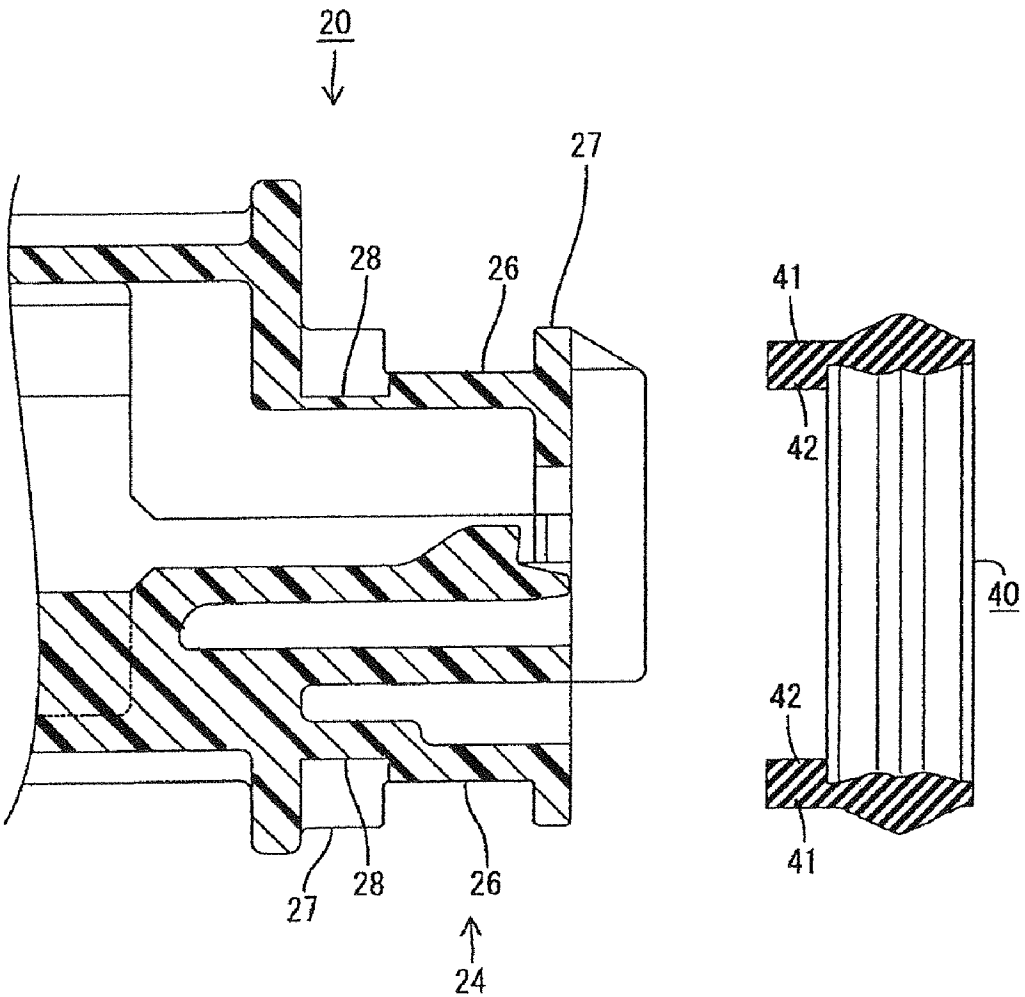
FIG. 5 is a sectional view of the connector housing and the sealing ring.
Figure 6:
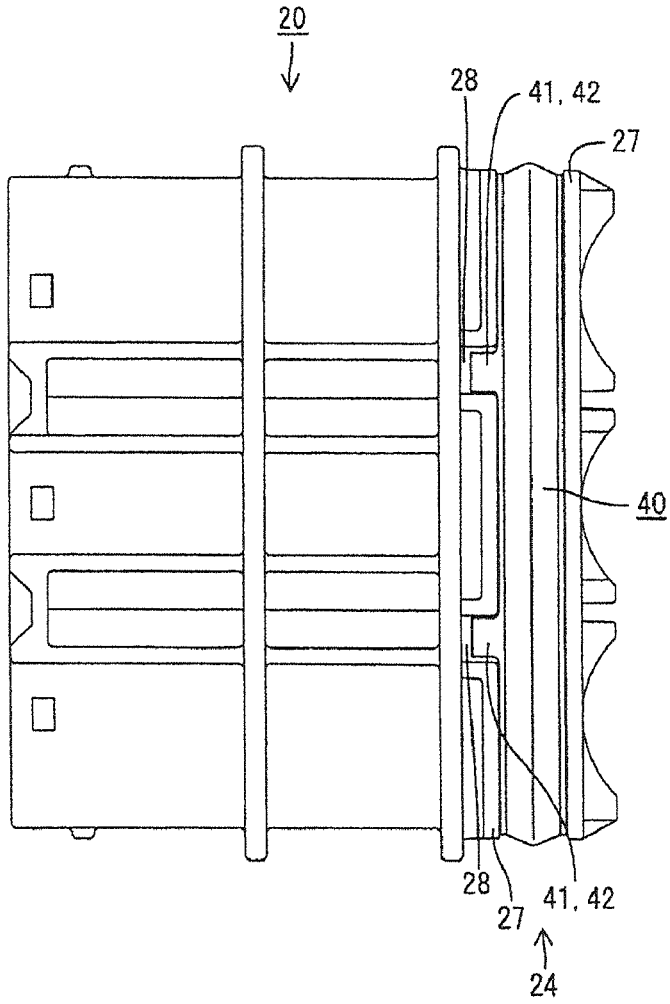
FIG. 6 is a plan view of a state in which the sealing ring is mounted on the connector housing.
Figure 7:
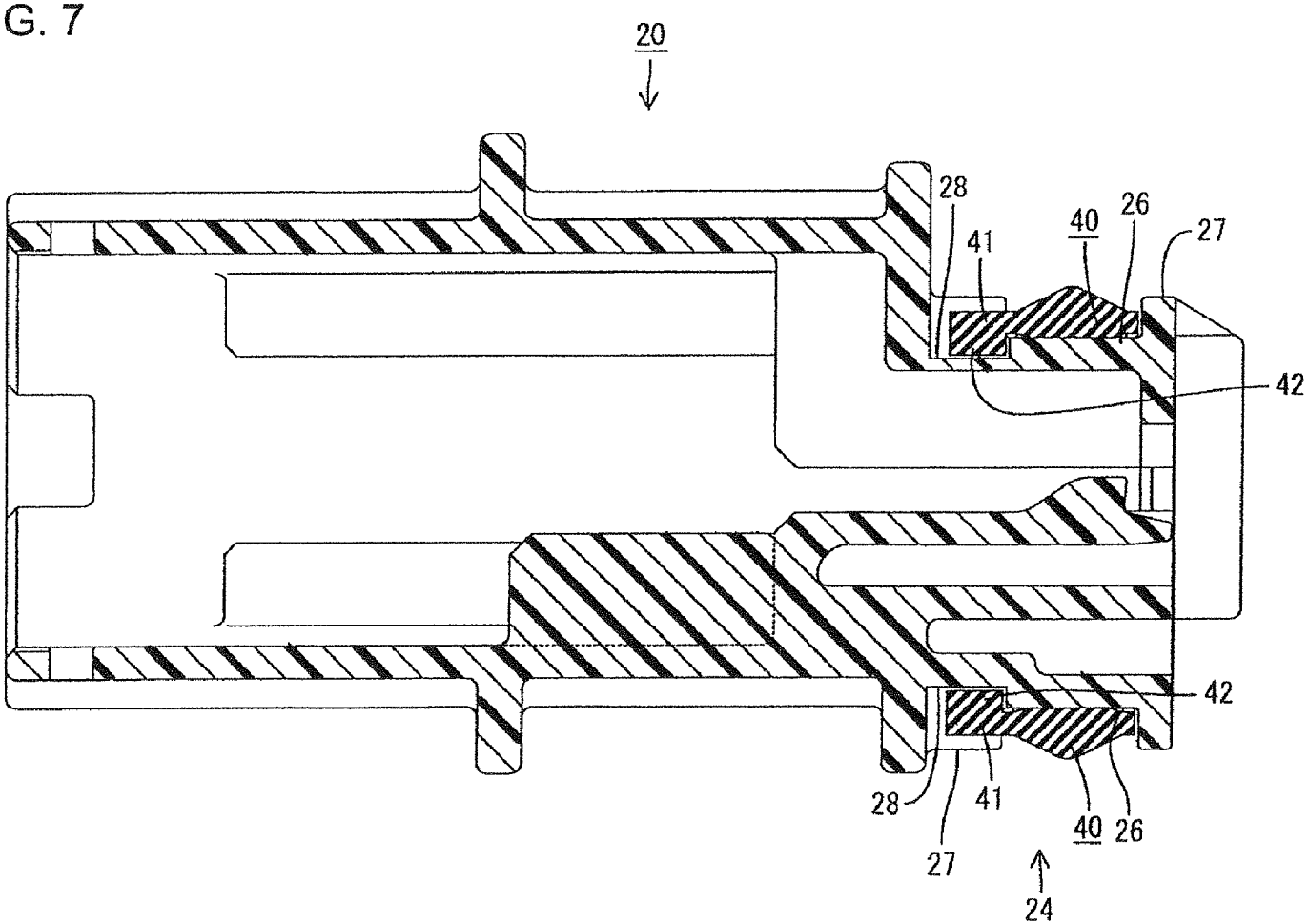
FIG. 7 is a sectional view of the state in which the sealing ring is mounted on the connector housing.

As shown in FIG. 3, the sealing ring 40 is oblong in correspondence to the configuration of the fit-on tubular portion 24 of the electric wire-side housing 20 and has a width slightly shorter than that of the annular holding groove 26. Two prism-shaped rotation-stopping projections 41 are formed by projecting them from each of a pair of longitudinal straight portions of the sealing ring 40 along a direction in which the engaging grooves 28 are extended.

An engaging claw 42 is formed at a distal end of each rotation-stopping projection 41 by projecting the engaging claw 42 toward the inner peripheral side of the sealing ring 40. The engaging claw 42 is prism-shaped and can be fitted on a bottom of the engaging groove 28. The thickness (dimension in a direction vertical to the bottom surface of the annular holding groove 26) of the rotation-stopping projection 41 including the engaging claw 42 is set to, for example, 2.5 mm.

As shown in FIG. 2, the sealing ring 40 is fit on the electric wire-side housing 20 with the rotation-stopping projection 41 disposed rearward. At this time, the sealing ring 40 is disposed inside the annular holding groove 26, and the engaging claw 42 is fit into the engaging groove 28.

In the above-described construction, the engaging claw 42 is engaged by the engaging groove 28. Therefore even though a force is inadvertently applied to the sealing ring 40 in a direction along the annular holding groove 26, the rotation-stopping projection 41 including the engaging claw 42 remains inside the engaging groove 28, and the sealing ring 40 continuous with the rotation-stopping projection 41 is fixed, with the sealing ring 40 being fitted in the annular holding groove 26. Thereby it is possible to prevent the sealing ring 40 from rotating along the annular holding groove 26.

Let it be supposed that the rotation-stopping projection 41 is formed at a circular-arc portion of the sealing ring 40. When a force is inadvertently applied to the sealing ring 40, at the circular-arc portion of the sealing ring 40, the force is applied to the sealing ring 40 and the rotation-stopping projection 41 outwardly from the center of the circular-arc portion. Therefore there is a possibility that the rotation-stopping projection 41 easily floats from the engaging groove 28 and separates therefrom.

The rotation-stopping projections 41 are formed on the longitudinal straight portions of the oblong section of the fit-on tubular portion 24. Therefore, the rotation-stopping projections 41 contact the side surface of the engaging grooves 28 and remain in the engaging grooves 28 if a force is applied to the sealing ring 40. In contrast, the sealing ring 40 would be likely to rotate along the annular holding groove 26 if the rotation-stopping projections 41 were formed on the circular-arc portion of the sealing ring 40.

Further, two rotation-stopping projections 41 are formed on each longitudinal straight portion of the oblong section of the fit-on tubular portion 24. Therefore, a force applied to the sealing ring 40 is received almost equally by the rotation-stopping projections 41 for further preventing the sealing ring 40 from rotating along the annular holding groove 26.

The invention is not limited to the embodiments described above with reference to the drawings. For example, the following embodiments are also included in the technical scope of the present invention.

Although the rotation-stopping projection 41 is formed at four positions in the above-described embodiment, the present invention is not limited to this form. The rotation-stopping projection may be formed at one position or at odd positions.

Although the engaging grooves 28 are formed by extending them rearward along the direction orthogonal to the annular holding groove 26 in the above-described embodiment, the present invention is not limited to this form. It is possible to form the engaging grooves 28 by extending them forward along a direction in which the engaging grooves 28 intersect with the annular holding groove 26 or form the engaging grooves 28 by extending them forward and rearward along the direction in which the engaging grooves 28 intersect with the annular holding groove 26.

The rotation-stopping projections 41 may project forward and rearward along a direction in which the rotation-stopping projections 41 intersect the sealing ring 40.

What is claimed is:

1. A connector comprising:

a housing having a fit-on tube with two opposed substantially planar walls and two opposed curved walls extending between the planar walls so that said fit-on tube defines a substantially oblong cross-section, the fit-on tube having opposite front and rear ends and an outer peripheral surface extending between the ends, an annular holding groove formed in the outer peripheral surface at a position between the front and rear ends and on a part of the housing that will be inserted into a mating connector, engaging grooves in the outer peripheral surface of the fit-on tube at the planar walls and extending rearward from the annular holding groove, each of said engaging grooves having two opposed flat surfaces aligned substantially perpendicular to the substantially planar walls, an outwardly facing bottom surface that is deeper than a bottom surface of said annular holding groove and a rearwardly facing front surface extending substantially perpendicularly from the bottom surface of the annular holding groove to the bottom surface of the engaging groove; and a sealing ring mounted on the annular holding groove, rotation-stopping projections projecting rearward from said sealing ring and into engagement with the flat surfaces of the respective engaging grooves and an inwardly projecting engaging claw at a rear end of each of the rotation-stopping projections and configured for fitting substantially on the bottom surface and the front surface of the respective engaging grooves.

2. The connector of claim 1, wherein each of the engaging claws is substantially rectangular.

3. The connector of claim 1, wherein each of the engaging claws has opposite side surfaces substantially aligned with the opposite side surfaces of the rotation-stopping projections and engaged respectively with the opposed side surfaces of the corresponding engaging groove.

* * * * *